US006959890B1

(12) United States Patent
Breitinger

(10) Patent No.: US 6,959,890 B1
(45) Date of Patent: Nov. 1, 2005

(54) COMBINATION ADJUSTABLE HOLDER TO RETAIN PREMOISTENED WIPES, TOILET PAPER AND/OR AIR FRESHENERS AND OTHER TOILET OBJECTS ADJACENT A TOILET

(76) Inventor: Peter Breitinger, 3628 Park Colony Ct., Agoura Hills, CA (US) 91301

( * ) Notice: Subject to any disclaimer, the term of this patent is extended or adjusted under 35 U.S.C. 154(b) by 156 days.

(21) Appl. No.: 10/717,807

(22) Filed: Nov. 19, 2003

(51) Int. Cl.[7] ..... B65H 16/02
(52) U.S. Cl. ..... 242/592; 242/598.5; 242/599.3; 221/97; 221/199
(58) Field of Search ..... 242/592, 594, 242/598.5, 599, 599.3; 221/45, 97, 199

(56) References Cited

U.S. PATENT DOCUMENTS

| | | | | |
|---|---|---|---|---|
| D245,225 | S | 8/1977 | Lyons | |
| 4,807,823 | A | 2/1989 | Wyant | |
| 5,311,986 | A | 5/1994 | Putz | |
| 5,443,084 | A | 8/1995 | Saleur | |
| D377,284 | S | 1/1997 | Farrow | |
| 5,660,313 | A | 8/1997 | Newbold | |
| 5,697,577 | A | 12/1997 | Ogden | |
| 6,047,920 | A * | 4/2000 | Dearwester et al. | 242/594.5 |
| 6,056,235 | A | 5/2000 | Brozinsky | |
| 6,273,359 | B1 | 8/2001 | Newman | |
| D450,960 | S | 11/2001 | Boyea | |
| D453,645 | S | 2/2002 | Jones | |
| 6,354,532 | B1 | 3/2002 | Escobedo | |
| D455,924 | S | 4/2002 | Zetsche | |
| D457,766 | S | 5/2002 | Ombdoll | |
| 6,394,324 | B1 | 5/2002 | Chen | |
| D458,490 | S | 6/2002 | Omdoll | |
| D460,305 | S | 7/2002 | Fletcher | |
| 6,422,503 | B1 | 7/2002 | Kong | |
| D461,667 | S | 8/2002 | Jordan | |
| D461,669 | S | 8/2002 | Cheng | |
| 6,443,043 | B1 | 9/2002 | Granger | |
| 6,446,903 | B1 * | 9/2002 | Bazan | 242/597.8 |
| 6,450,439 | B1 | 9/2002 | Van Rees | |
| 6,457,394 | B1 | 10/2002 | Granger | |
| 6,460,799 | B1 | 10/2002 | Ryan | |
| 6,474,209 | B1 | 11/2002 | Granger | |
| 6,476,365 | B1 | 11/2002 | Rios | |
| D467,454 | S | 12/2002 | Le | |
| D468,113 | S | 1/2003 | Henning | |
| D468,567 | S | 1/2003 | Trevett | |
| D472,087 | S | 3/2003 | Goodman | |
| 6,527,219 | B1 | 3/2003 | Trecartin | |
| 6,537,631 | B1 | 3/2003 | Rivera | |
| D472,414 | S | 4/2003 | Gilbert | |

(Continued)

*Primary Examiner*—John Q. Nguyen
(74) *Attorney, Agent, or Firm*—Thomas I. Rozsa; Tony D. Chen

(57) ABSTRACT

A combination holder to be used by a person when the person is using a toilet. The preferred embodiment includes an openable container to retain objects such as premoistened wipes. Beneath the openable container is an openable ring for retaining a roll of toilet paper from which sheets of toilet paper may be dispensed as needed. Beneath the openable ring is a tray for retaining objects such as an air freshener or any other toiletries which are useful for the person while the person is using the toilet. The tray is on an adjustable wall so that the distance between the tray and the openable ring can be increased to facilitate providing more vertical room above the tray. The preferred adjustable means is a ratchet mechanism so that any multiplicity of adjustable distances can be achieved between the openable ring and the tray.

12 Claims, 2 Drawing Sheets

U.S. PATENT DOCUMENTS 6,554,134 B1 4/2003 Guibert
6,557,797 B1 5/2003 Bonamarte
6,568,625 B2 5/2003 Faulks

* cited by examiner

COMBINATION ADJUSTABLE HOLDER TO RETAIN PREMOISTENED WIPES, TOILET PAPER AND/OR AIR FRESHENERS AND OTHER TOILET OBJECTS ADJACENT A TOILET

BACKGROUND OF THE INVENTION

1. Field of the Invention

The present invention generally relates to the field of toilet accessories that are useful for retaining objects which a person would use while on the toilet.

2. Description of the Prior Art

In general, toilet tissue holders are well known in the prior art. To facilitate elevated personal hygiene, it has also been known to have a holder for premoistened towelettes to dispense these adjacent a toilet. The following patents disclose the known prior art in this field.

1. U.S. Pat. No. Des. 245,225 issued to Lyons on Aug. 2, 1977 for "Moist Towel Dispenser" (hereafter the "Lyons Patent");
2. U.S. Pat. No. 4,807,823 issued to Wyant on Feb. 28, 1989 for "Bathroom Tissue Dispenser" (hereafter the "Wyant Patent");
3. U.S. Pat. No. 5,311,986 issued to Putz on May 17, 1994 for "Premoistened Wipe Dispenser For Conventional Toilet-Tissue Roll Holders" (hereafter the "Putz Patent");
4. U.S. Pat. No. 5,443,084 issued to Saleur on Aug. 22, 1995 for "Paper Moistener Device And Moist Toilet Paper Dispenser" (hereafter the "Saleur Patent");
5. U.S. Pat. No. Des. 377,284 issued to Farrow on Jan. 14, 1997 for "Combined Toilet Paper And Moist Towelette Dispenser" (hereafter the "Farrow Patent");
6. U.S. Pat. No. 5,660,313 issued to Newbold on Aug. 26, 1997 for "Premoistened Toilet Paper And Dispenser" (hereafter the "Newbold Patent");
7. U.S. Pat. No. 5,697,577 issued to Ogden on Dec. 16, 1997 for "Premoistened Toilet Paper Dispenser" (hereafter the "Ogden Patent");
8. U.S. Pat. No. 6,056,235 issued to Brozinsky on May 2, 2000 for "Refillable Dispenser For Replacing Standard Roll Of Toilet Tissue with Roll Of Pre-Moistened Wipes" (hereafter the "Brozinsky Patent");
9. U.S. Pat. No. US 6,273,359 B1 issued to Newman on Aug. 14, 2001 for "Dispensing System And Method For Premoistened Wipes" (hereafter the "Newman Patent");
10. U.S. Pat. No. US D450,960 S issued to Boyea on Nov. 27, 2001 for "Wipes Container" (hereafter the "Boyea Patent");
11. U.S. Pat. No. US D354,645 S issued to Jones on Feb. 19, 2002 for "Toilet Paper Roll Dispenser" (hereafter the "Jones Patent");
12. U.S. Pat. No. US 6,354,532 B1 issued to Escobedo on Mar. 12, 2002 for "Toilet Paper Dispensing System" (hereafter the "Escobedo Patent");
13. U.S. Pat. No. US D455,924 S issued to Zetsche on Apr. 23, 2002 for "Holder For Spare Toilet Paper" (hereafter the "Zetsche Patent");
14. U.S. Pat. No. US 6,394,324 B1 issued to Chen on May 28, 2002 for "Dispensing Device For Moist Towel" (hereafter the "Chen Patent");
15. U.S. Pat. No. US D457,766 S issued to Omdoll on May 28, 2002 for "Toilet Paper Dispenser" (hereafter the "Omdoll Patent");

16. U.S. Pat. No. US D458,490 S issued to Omdoll on Jun. 11, 2002 for "Toilet Paper Dispenser" (hereafter the "Omdoll Patent");
17. U.S. Pat. No. US 6,405,972 B1 issued to Wakam on Jun. 18, 2002 for "Toilet Paper Roll Storage And Dispenser" (hereafter the "Wakam Patent");
18. U.S. Pat. No. US D460,305 S issued to Fletcher on Jul. 16, 2002 for "Toilet Paper Roll Dispenser" (hereafter the "Fletcher Patent");
19. U.S. Pat. No. US D460,305 S issued to Fletcher on Jul. 16, 2002 for "Toilet Paper Roll Dispenser" (hereafter the "Fletcher Patent");
20. U.S. Pat. No. US 6,422,503 B1 issued to Hoo Kong on Jul. 23, 2002 for "Toilet Paper Roll Dispenser" (hereafter the "Hoo Kong Patent");
21. U.S. Pat. No. US D361,667 S issued to Jordan on Aug. 20, 2002 for "Toilet Paper Tree" (hereafter the "Jordan Patent");
22. U.S. Pat. No. US D461,669 S issued to Cheng on Aug. 20, 2002 for "Floor Stand For Toilet Paper And A Toilet Bowl Brush" (hereafter the "Cheng Patent");
23. U.S. Pat. No. US 6,443,043 B1 issued to Granger on Sep. 3, 2002 for "Automatic Dispensing Apparatus For Paper Towels And Toilet Paper" (hereafter the "Granger Patent");
24. U.S. Pat. No. US 6,450,439 B1 issued to Van Rees on Sep. 17, 2002 for "Toilet Paper Roll Dispenser" (hereafter the "Van Rees Patent");
25. U.S. Pat. No. US 6,457,394 B1 issued to Granger on Oct. 1, 2002 for "Wiping Material And Toilet Paper Dispensing Apparatus With Automatic Or Semiautomatic Functioning" (hereafter the "Granger Patent");
26. U.S. Pat. No. US 6,460,799 B1 issued to Ryan on Oct. 8, 2002 for "Toilet Paper Holding Device" (hereafter the "Ryan Patent");
27. U.S. Pat. No. US 6,474,209 B1 issued to Granger on Nov. 5, 2002 for "Automatic Or Semi Automatic Wiping Material And Toilet Paper Dispenser" (hereafter the "Granger Patent");
28. U.S. Pat. No. US 6,476,365 B1 issued to Rios on Nov. 5, 2002 for "Toilet Paper Dispenser" (hereafter the "Rios Patent");
29. U.S. Pat. No. US D467,454 S issued to Le on Dec. 24, 2002 for "Container For Wipes" (hereafter the "Le Patent");
30. U.S. Pat. No. US D468,113 S issued to Henning on Jan. 7, 2003 for "Surface Pattern For Hygienic Articles Such As Paper Towels," (hereafter the "Henning Patent");
31. U.S. Pat. No. US D468,567 S issued to Trevett on Jan. 14, 2003 for "Moist Wipes Container" (hereafter the "Trevett Patent");
32. U.S. Pat. No. US 6,527,219 B1 issued to Trecartin on Mar. 4, 2003 for "Toilet Paper Dispensing System" (hereafter the "Trecartin Patent");
33. U.S. Pat. No. US D472,087 S issued to Goodman on Mar. 25, 2003 for "Toilet Tissue Holder" (hereafter the "Goodman Patent");
34. U.S. Pat. No. US 6,537,631B1 issued to Rivera on Mar. 25, 2003 for "Roll Of Wet Wipes" (hereafter the "Rivera Patent");
35. U.S. Pat. No. US D472,414 S issued to Gilbert on Apr. 1, 2003 for "Toilet Tissue Holder" (hereafter the "Gilbert Patent");
36. U.S. Pat. No. US 6,554,134 B1 issued to Guibert on Apr. 29, 2003 for "Case For Products Such As Moist" (hereafter the "Guibert Patent");

37. U.S. Pat. No. US 6,557,797 B1 issued to Bonamarte on May 6, 2003 for "Integral Toilet Paper Roll And Support Spindle" (hereafter the "Bonamarte Patent");
38. U.S. Pat. No. US 6,568,625 B2 issued to Faulks on May 27, 2003 for "Wet Wipes Dispenser And Mounting System" (hereafter the "Faulks Patent").

While the above prior art does disclose a dispenser for a roll of toilet paper and a dispenser for premoistened towelettes, there is a significant need for an improved combination retainer to retain objects which are useful to a person when a person is using a toilet.

SUMMARY OF THE INVENTION

In the preferred embodiment, the present invention is a combination holder to be used by a person when the person is using a toilet. The preferred embodiment includes an openable container to retain objects such as premoistened wipes. Beneath the openable container is an openable ring for retaining a roll of toilet paper from which sheets of toilet paper may be dispensed as needed. Beneath the openable ring is a tray for retaining objects such as air fresheners and/or any other toiletries which are useful for the person while the person is using the toilet. The tray is on an adjustable wall so that the distance between the tray and the openable ring can be increased to facilitate providing more vertical room above the tray. The preferred adjustable means is a ratchet mechanism so that any multiplicity of adjustable distances can be achieved between the openable ring and the tray.

In an alternative embodiment of the present invention, only the openable container to retain objects such as the premoistened wipes and the openable ring for retaining a roll of toilet paper are included.

In the broadest embodiment of the present invention, only the openable container to retain objects such as the premoistened wipes is included.

It has been discovered, according to the present invention, that retaining a fill line of toilet items for use by a person when the person is using the toilet can be achieved through a combination of a slidable holder which includes an openable container to retain objects such as premoistened wipes, combined with an openable ring beneath the container, the openable ring used to retain a roll of toilet paper from which sheets of toilet paper may be dispensed as needed, combined with tray for retaining objects, the distance between the tray and the ring for holding toilet paper being adjustable to facilitate the height of the objects retained in the tray such as an air freshener or toiletries.

It is therefore an object of the present invention to provide a retainer adjacent the toilet to retain objects useful to a person while the person is using the toilet, including premoistened towelettes, toilet paper, and other toiletries or air fresheners.

It is also an object of the present invention to provide a subcombination retainer for retaining only the premoistened wipes and the roll of toilet paper or only the premoistened wipes.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
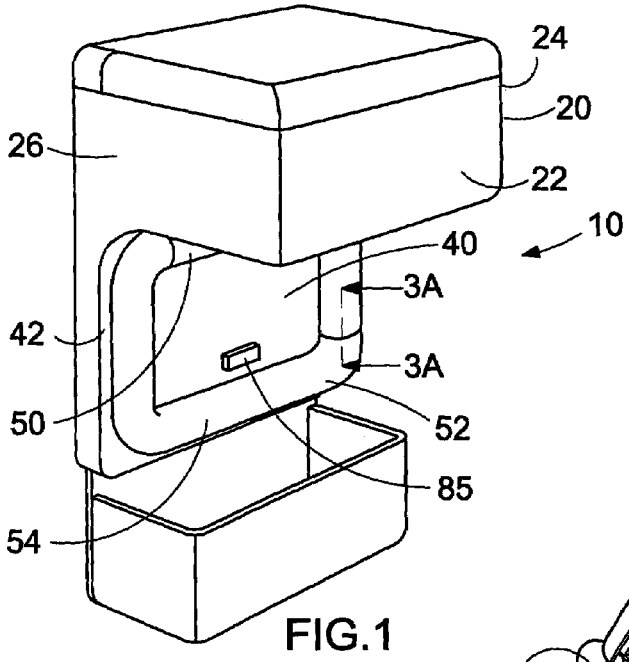
FIG. 1 is a perspective view of the present invention combination adjustable holder to retain premoistened wipes, a roll of toilet paper, and objects such as an air freshener and toiletries.
Figure 3A:
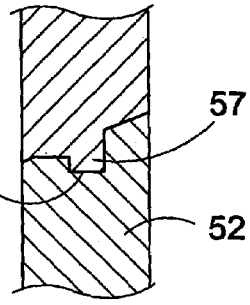
FIG. 3A is a cross-sectional view taken along line 3A—3A of FIG. 3.
Figure 3:
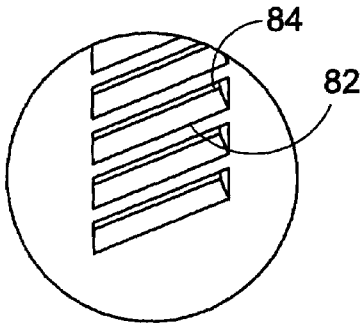
FIG. 3 is an enlarged view of the adjustment ratchet mechanism from the embodiment of the present invention illustrated in FIG. 2.
Figure 2:
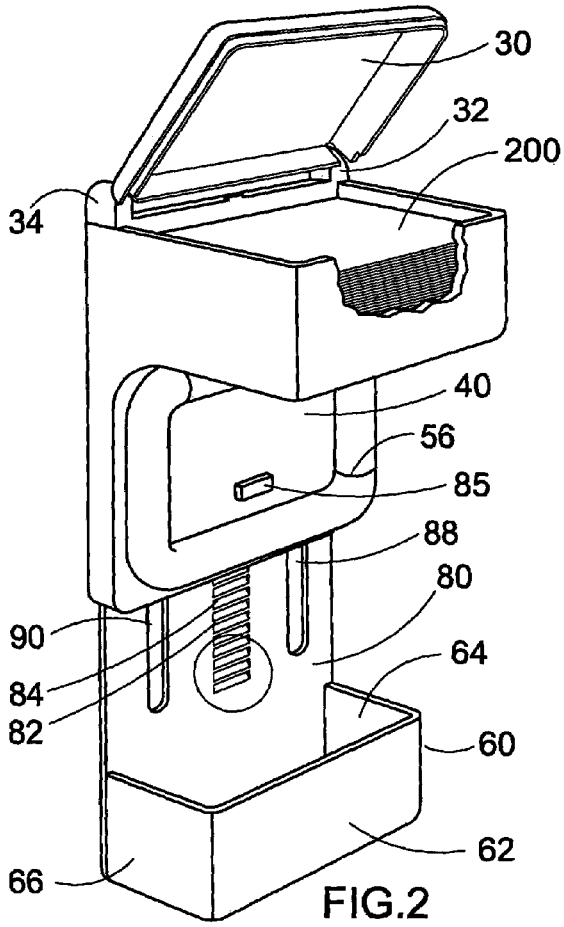
FIG. 2 is a perspective view of the present invention, illustrating the adjustment means to expand the lower tray for the combination adjustable holder to retain premoistened wipes, a roll of toilet paper, and objects such as an air freshener and toiletries.

Referring to FIGS. 1 through 3, there is illustrated the preferred embodiment of the present invention combination holder 10. The top portion of the combination holder 10 comprises an openable container 20 having front wall 22, sidewalls 24 and 26, a back wall 36 (see FIG. 5), and a bottom wall not shown. Back wall 36 extends for a distance below the container 20. The front wall 22, sidewalls 24 and 26, back wall 36 and bottom wall form a container into which objects can be placed. The preferred object is premoistened towelettes 200. The container 20 includes a top 30 which is rotatably connected to first raised wall 32 and second raised wall 34 which extends above sidewalls 24 and 26 respectively. The top 30 rests against sidewalls 24 and 26 and front wall 22 when in the closed condition as illustrated in FIG. 1. The top 30 is rotatably opened to expose the premoistened towelettes 200 as illustrated in FIG. 2.

Immediately below the openable container 20 is a vertical wall 40 having a front surface 42. A cylindrical support 50 is connected at the intersection of the bottom wall of container 20 and the front surface 42 of vertical wall 40. A ring 52 is rotatably supported on the cylindrical support 50. The ring 52 as illustrated is generally rectangular in shape with rounded corners, although any shape ring is within the spirit and scope of the present invention. The lower bar 54 of ring 52 holds a roll of toilet paper in a manner by which sheets of toilet paper can be unrolled in the conventional manner as the toilet paper is rolled on lower bar 54. The ring 52 is rotatably supported on cylindrical support 50 so that the user can rotate the roll of toilet paper towards the user in addition to rolling the roll of toilet paper on lower bar 54 of ring 52 as the toilet paper is dispensed. The ring 50 is openable by means of a break 56 in the ring 52. The break includes mating fastening means such as a male member 57 on one portion of the ring 52 adjacent the break 56 and a mating female member 58 located on respective opposite portions of the ring 52 adjacent the break 56 as illustrated in the detailed view in FIG. 3A. The toilet paper is inserted onto the ring 52 at the location of the break when the male 57 and female 58 fastening members are separated. After the toilet paper rests on lower bar 54, the ring 52 is closed.

The third component of the combination holder 10 is a tray 60 mounted on a slidable wall 80. The tray 60 comprises a front wall 62, a first sidewall 64, a second sidewall 66 and a bottom wall (not shown). A portion of slidable wall 80 also serves as the rear wall of tray 60. Slidable wall 80 is slidably mounted in an opening between vertical wall 40 and the portion of the rear wall 36 extending below container 20. Rear wall 36 and vertical wall 40 are parallel. Slidable wall 80 has a multiplicity of vertically aligned ratchet openings 82 having spaced walls 84. A mating pawl or tooth member 85 is aligned on the front wall 40 and is a pushbutton which has a mating tooth to catch a respective ratchet opening 82 to thereby position the tray 60 at any desired elevation below ring 52 and also below the bottom wall of openable container 20. The pushbutton 85 and its tooth are pushed in to release the tooth from a given ratchet opening 82 so the wall 80 can be slid up and/or downward so that the tooth can catch another ratchet opening 82. The ratchet openings 82 and mating pawl 85 can be generally described as height adjustment means.

A pair of parallel tracks 88 and 90 are formed within slidable wall 80 and are supported on respective retaining members such as cylindrical dowels within the space between vertical wall 40 and rear wall 36 so that slidable wall 80 will not come out of the space between vertical wall 40 and rear wall 36.

Through the present invention, the tray 60 can be at its uppermost position as illustrated in FIG. 1, at its lowermost position as illustrated in FIG. 3, or at any elevation therebetween. The tray 60 can hold an air freshener or any other toiletries useful to the user when the user is using the toilet.

Figure 4:
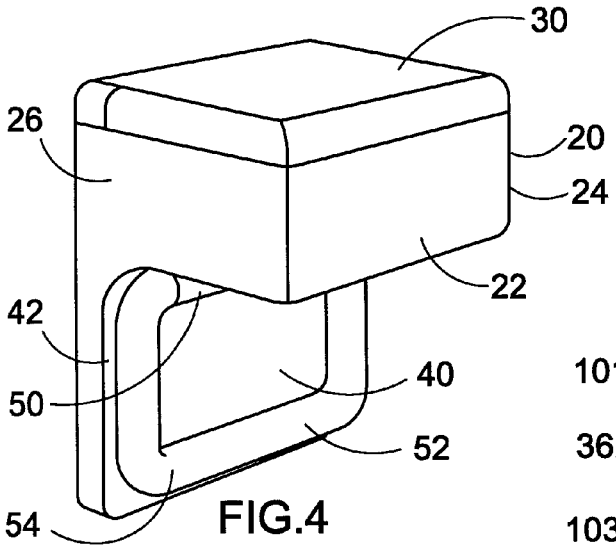
FIG. 4 is a perspective view of an alternative embodiment of the present invention which is a combination holder to retain premoistened wipes and a roll of toilet paper.
Figure 5:
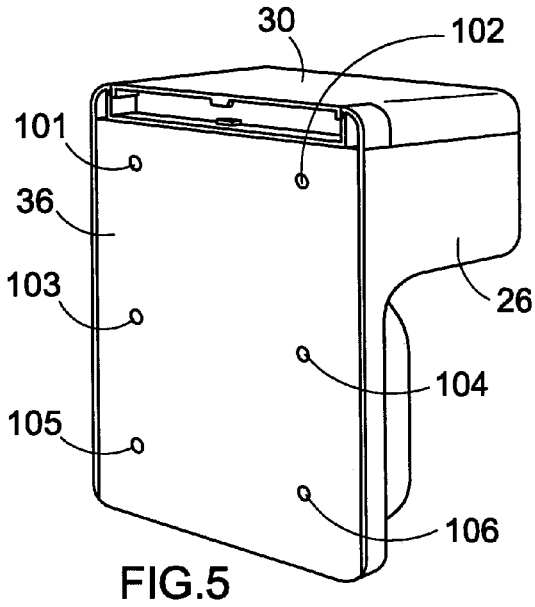
FIG. 5 is a rear perspective view of the present invention.
Figure 6:
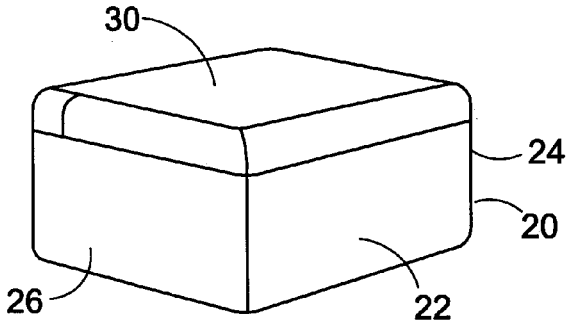
FIG. 6 is a perspective view of another alternative embodiment of the present invention which is a holder to retain premoistened wipes.

Alternative mounting means can be used to mount the combination holder 10 to a wall adjacent the toilet. The embodiment shown in FIGS. 4 and 5 is the same embodiment shown in FIGS. 1 to 3 with the slidable wall 86 and tray 60 removed. As illustrated in FIG. 5, the rear wall 36 may have a multiplicity of openings such as three pairs of spaced apart parallel openings 101 and 102, 103 and 104 and 105 and 106 as illustrated. A pair of nails or screws can be placed into the wall and aligned with one of the pairs of openings. Also, more nails or screws can be placed in the wall to be aligned to two pairs or even three pairs of the parallel sets of openings in the rear wall 36.

Figure 7:
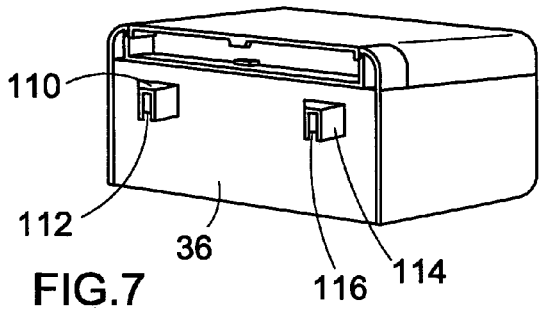
FIG. 7 is a rear perspective view of the embodiment of the present invention illustrated in FIG. 6.

Another alternative mounting means is illustrated in FIG. 7 which can also be placed on the rear wall 36 of the embodiment on FIGS. 1 to 3. In this embodiment, a pair of parallel spaced apart brackets 110 and 114 are mounted on rear wall 36. Bracket 110 has a rear elongated opening 112 and bracket 114 has a rear elongated opening 116. A pair of nails or screws is placed into the wall with each respective nail or screw slid through a respective opening 112 and 116 to be held by brackets 110 and 114.

It will be appreciated that the above two variations are only two of many different types of mounting means by which the combination holder 10 can be mounted on the wall adjacent the toilet.

While the preferred embodiment of the present invention is to have all three components, namely the openable container 20, the ring 52 to rotatably support a roll of toilet paper and the slidable tray 60 to hold an air freshener or other toiletries, it is also within the spirit and scope of the present invention to have sub-combinations of the device. As illustrated in FIG. 4, one alternative sub-combination is to have only the openable container 20 to retain premoistened towelettes and the ring 52 for retaining the roll of toilet paper. The broadest alternative embodiment is to have only the openable container to retain premoistened towelettes.

In the preferred embodiment, the combination holder 10 is manufactured out of pre-molded plastic. It will be appreciated that the holder 10 can be made out of any other suitable material including polypropylene, polyvinyl or wood.

Defined in detail, the present invention is a combination holder for use with premoistened towelettes, a roll of toilet paper, air freshener and toiletries, comprising: (a) a top portion having an openable container having a front wall, sidewalls, a back wall which extends a distance below the container, a bottom wall and a top which is rotatably mounted to the container, the front wall, sidewalls, bottom wall, back wall and top surrounding an interior compartment; (b) a vertical wall below the openable container, the vertical wall having a front surface and spaced apart from the portion of the back wall which extends below the container so that an opening is formed between the back wall and the vertical wall; (c) a cylindrical support connected to the vertical wall at the location where the vertical wall and the bottom wall of the container intersect, the cylindrical support rotatably supporting an openable ring having a lower horizontally disposed bar; (d) a slidable wall supported within the opening between the back wall and the vertical wall, the slidable wall having a multiplicity of ratchet teeth which respectively engage with a pawl supported on the vertical wall so that the slidable wall can be slid to a desired distance below the ring; and (e) a tray mounted on the slidable wall, the tray having a front wall, sidewalls and a bottom, a portion of the slidable wall serving as the rear wall of the tray, the tray being open at its top; (f) whereby, the openable container retains the premoistened wipes, the ring opens to receive a roll of toilet paper and the ring rotatably retains the roll of toilet paper, and the tray retains the air freshener and toiletries at any desired distance below the ring.

Defined more broadly, the present invention is a combination holder for use with premoistened towelettes, a roll of toilet paper, and objects, comprising: (a) a top portion having an openable container having circumferential walls, a back wall which extends a distance below the container, a bottom wall and a top which is openably mounted to the container, the circumferential walls, bottom wall, back wall and top surrounding an interior compartment; (b) a vertical wall below the openable container, the vertical wall having a front surface and spaced apart from the portion of the back wall which extends below the container so that an opening is formed between the back wall and the vertical wall; (c) a support connected to the holder at a location below the openable container, the support rotatably supporting an openable ring; (d) a slidable wall supported within the opening between the back wall and the vertical wall, the slidable wall having adjustment means which work in concert with the vertical wall so that the slidable wall can be slid to a desired distance below the ring; and (e) a tray mounted on the slidable wall, the tray having a circumferential wall and a bottom, a portion of the slidable wall serving as the rear wall of the tray, the tray being open at its top; (f) whereby, the openable container retains the premoistened wipes, the ring opens to receive a roll of toilet paper and the ring rotatably retains the roll of toilet paper, and the tray retains the objects at any desired distance below the ring.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A combination holder for use with premoistened towelettes, a roll of toilet paper, air freshener and toiletries, comprising:

a. a top portion having an openable container having a front wall, sidewalls, a back wall which extends a distance below the container, a bottom wall and a top which is rotatably mounted to the container, the front wall, sidewalls, bottom wall, back wall and top surrounding an interior compartment;

b. a vertical wall below said openable container, the vertical wall having a front surface and spaced apart from the portion of the back wall which extends below the container so that an opening is formed between the back wall and the vertical wall;

c. a cylindrical support connected to the vertical wall at the location where the vertical wall and the bottom wall of the container intersect, the cylindrical support rotatably supporting an openable ring having a lower horizontally disposed bar;

d. a slidable wall supported within the opening between said back wall and said vertical wall, the slidable wall having a multiplicity of ratchet teeth which respectively engage with a pawl supported on said vertical wall so that the slidable wall can be slid to a desired distance below said ring; and e. a tray mounted on said slidable wall, the tray having a front wall, sidewalls and a bottom, a portion of said slidable wall serving as the rear wall of the tray, the tray being open at its top;

f. whereby, said openable container retains the premoistened wipes, the ring opens to receive a roll of toilet paper and the ring rotatably retains the roll of toilet paper, and the tray retains the air freshener and toiletries at any desired distance below the ring.

2. The combination holder in accordance with claim 1, further comprising means to mount said combination holder to a wall.

3. The combination holder in accordance with claim 2, wherein said mounting means are a pair of spaced apart brackets on said rear wall, each bracket designed to receive a retaining nail or screw which has been fastened to a wall adjacent a toilet.

4. The combination holder in accordance with claim 2, wherein said mounting means includes at least one pair of spaced apart openings in said back wall, each opening designed to receive a retaining nail or screw which has been fastened to a wall adjacent a toilet.

5. The combination holder in accordance with claim 1, wherein said openable ring further comprises a break in the ring, with mating fastener members in said ring adjacent the location of the break.

6. The combination holder in accordance with claim 1, wherein said combination holder is made of plastic.

7. A combination holder for use with premoistened towelettes, a roll of toilet paper, and objects, comprising:

a. a top portion having an openable container having circumferential walls, a back wall which extends a distance below the container, a bottom wall and a top which is openably mounted to the container, the circumferential walls, bottom wall, back wall and top surrounding an interior compartment;

b. a vertical wall below said openable container, the vertical wall having a front surface and spaced apart from the portion of the back wall which extends below the container so that an opening is formed between the back wall and the vertical wall;

c. a support connected to the holder at a location below said openable container, the support rotatably supporting an openable ring;

d. a slidable wall supported within the opening between said back wall and said vertical wall, the slidable wall having adjustment means which work in concert with said vertical wall so that the slidable wall can be slid to a desired distance below said ring; and e. a tray mounted on said slidable wall, the tray having a circumferential wall and a bottom, a portion of said slidable wall serving as the rear wall of the tray, the tray being open at its top;

f. whereby, said openable container retains the premoistened wipes, the ring opens to receive a roll of toilet paper and the ring rotatably retains the roll of toilet paper, and the tray retains the objects at any desired distance below the ring.

8. The combination holder in accordance with claim 7, further comprising means to mount said combination holder to a wall.

9. The combination holder in accordance with claim 8, wherein said mounting means are a pair of spaced apart brackets on said rear wall, each bracket designed to receive a retaining nail or screw which has been fastened to a wall adjacent a toilet.

10. The combination holder in accordance with claim 8, wherein said mounting means includes at least one pair of spaced apart openings in said back wall, each opening designed to receive a retaining nail or screw which has been fastened to a wall adjacent a toilet.

11. The combination holder in accordance with claim 7, wherein said openable ring further comprises a break in the ring, with mating fastener members in said ring adjacent the location of the break.

12. The combination holder in accordance with claim 7, wherein said combination holder is made of plastic.

* * * * *